US007634216B2

(12) United States Patent
Maeshima et al.

(10) Patent No.: US 7,634,216 B2
(45) Date of Patent: Dec. 15, 2009

(54) IMAGE FORMING DEVICE

(75) Inventors: Masanobu Maeshima, Osaka (JP); Taisuke Nagao, Osaka (JP); Yoshihiro Yamagishi, Mie (JP)

(73) Assignee: Kyocera Mita Corporation, Osaka (JP)

( * ) Notice: Subject to any disclaimer, the term of this patent is extended or adjusted under 35 U.S.C. 154(b) by 254 days.

(21) Appl. No.: 11/790,061

(22) Filed: Apr. 23, 2007

(65) Prior Publication Data

US 2007/0253742 A1 Nov. 1, 2007

(30) Foreign Application Priority Data

Apr. 26, 2006 (JP) ..... 2006-121505

(51) Int. Cl.
*G03G 15/08* (2006.01)

(52) U.S. Cl. ..... 399/257; 399/227; 399/258

(58) Field of Classification Search ..... 399/53, 399/227, 257, 43, 236
See application file for complete search history.

(56) References Cited

U.S. PATENT DOCUMENTS 6,324,354 B1 11/2001 Tode et al.
7,020,405 B2 * 3/2006 Ishikawa et al. ..... 399/50
2004/0146316 A1 * 7/2004 Yamada et al. ..... 399/227
2004/0265008 A1 * 12/2004 Tomono et al. ..... 399/227
2006/0072940 A1 * 4/2006 Morita et al. ..... 399/227

FOREIGN PATENT DOCUMENTS

JP 2000-330379 A 11/2000
JP 2002-351188 A 12/2002

* cited by examiner

*Primary Examiner*—David M Gray
*Assistant Examiner*—Roy Yi
(74) *Attorney, Agent, or Firm*—Shinjyu Global IP

(57) ABSTRACT

The image forming device of the present invention is able to be configured such that it has an image carrier that carries electrostatic latent image, a rotary type developing unit having a plurality of developing machines that stores toner in the interior thereof and is able to develop the electrostatic latent image by providing toner on the image carrier, and a control unit that is configured to execute a toner discharge process that discharges a portion of toner in the interior of a developing machine mentioned after rotating the developing unit, during a time that an image is not being formed and after a single color image formation using only a developing machine out of the plurality of developing machines.

14 Claims, 9 Drawing Sheets

IMAGE FORMING DEVICE

CROSS-REFERENCE TO RELATED APPLICATIONS

This application claims priority to Japanese Patent Application No. 2006-121505 filed on Apr. 26, 2006. The entire disclosure of Japanese Patent Application No. 2006-121505 is hereby incorporated herein by reference.

BACKGROUND OF THE INVENTION

1. Field of the Invention

The present invention generally relates to an image forming device. More specifically, the present invention relates to an image forming device having a rotary type developing unit, and configured to make an image appear using this developing unit.

2. Background Information

Conventionally, in an image forming device that is able to record a color image on a recording paper, a technology of developing an electrostatic latent image is known. This technology uses a rotary type developing unit having a developing machine corresponding to each of the plurality of toner colors including a black color. This kind of image forming device is used as a multifunction device, and has a combination of a plurality of functions of a copying machine, a printer, a fax machine, an internet fax machine, and any function within these functions.

Due to the change in the particle size distribution of toner stored in the developing machine and degradation due to the contact between toners and the like, the quality of the image printed on the recording paper may be deteriorated because the image density of the image printed on the recording paper is lowered, or because of surface fogging, or the like. Especially when a rotary type developing unit is used, since the capacity of the portion that stores toner in the interior of the developing unit is small, the above described problem occurs easily due to the change in the particle size distribution of toner and the like.

An image forming device is disclosed in Japanese Patent Application Publication No. 2000-330379 (disclosed on Nov. 30, 2000), such that in order to resolve this problem, for example, an alternation electric field is impressed between the photosensitive drum and the developing sleeve that conveys toner to a developing region on the photosensitive drum. Thus, toner remaining on the surface of the developing sleeve is attracted to the photosensitive drum, and the developing sleeve is refreshed.

When the developing machine is in a stationary state, toner becomes accumulates in the interior of the developing machine, and the particle size distribution of toner changes. The rotary type developing unit is different from a black and white printer, which is not a rotary type, and by the rotary rotation when color printing, it is possible to mix toner in the interior of the developing machine. Therefore, in a rotary type developing unit, the problem of change in the toner particle size distribution seems to be relatively unlikely to happen.

However, even with a rotary type developing unit, the developing unit does not rotary rotate when printing in black and white. More specifically, when printing in black and white, the rotary type developing unit will perform developing in a state in which the developing machine containing the black toner is stopped at a position opposite the photosensitive drum. Then, even with a rotary type developing unit, a portion of toner in the interior of the developing machine is accumulated, and change in the toner particle size distribution and the like may happen.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

An object of the present invention is to provide an image forming device that is able to suppress the progression of the deterioration of toner, in view of the above problem.

In order to achieve this object, the image forming device of the present invention includes an image carrier, a rotary type developing unit, and a control unit. The image carrier carries an electrostatic latent image. The rotary type developing unit has a plurality of developing machines that stores toner in the interior thereof and is able to develop the electrostatic latent image by providing toner on the image carrier. The control unit is configured to execute a toner discharge process that discharges a portion of toner in the interior of one of the plurality of developing machines after rotating the developing unit during a time that an image is not being formed and after a single color image formation using only the appropriate developing machine from among the plurality of developing machines.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
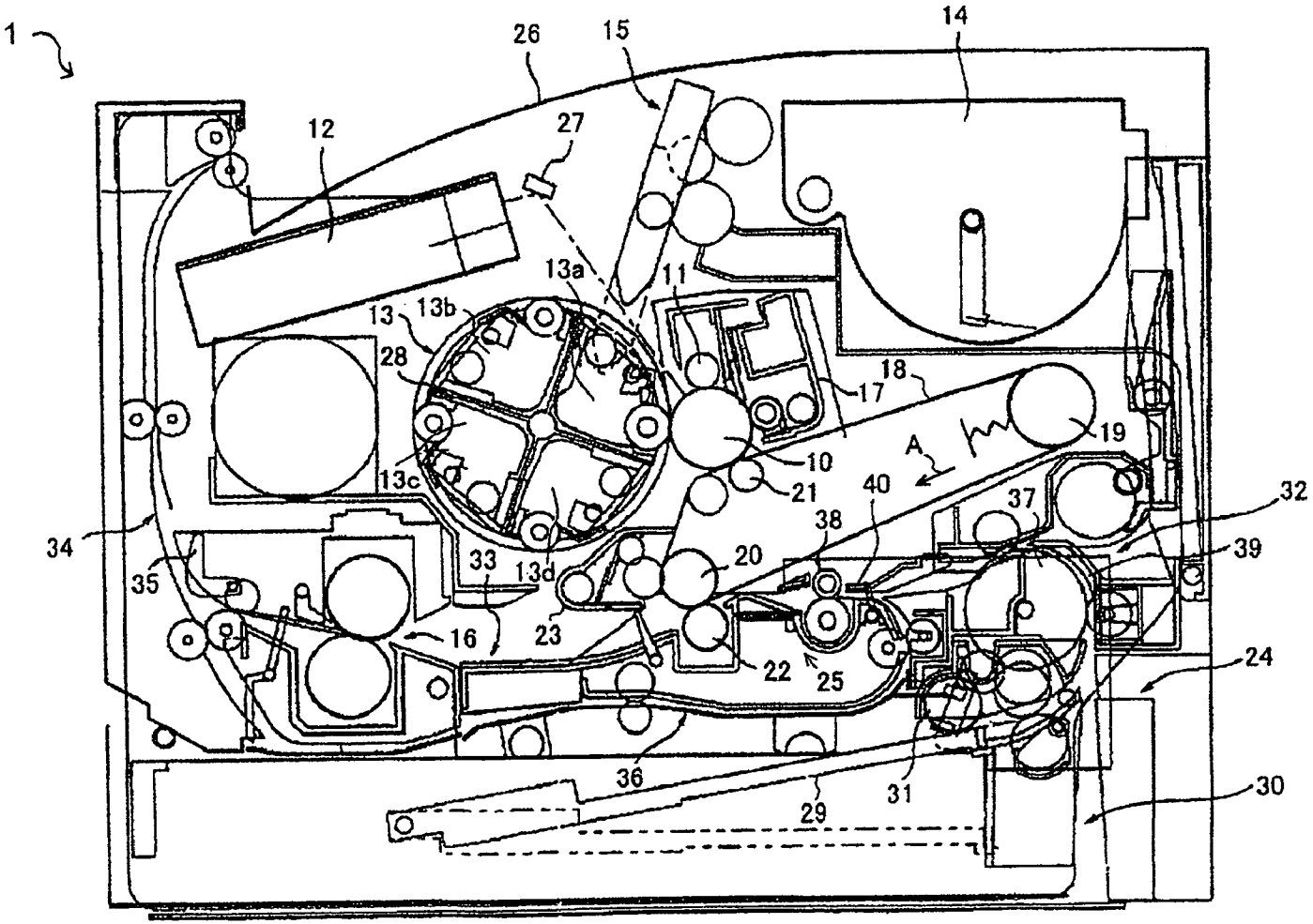
FIG. 1 is a cross-sectional view showing the structure of the main portions of a printer in accordance with a first preferred embodiment of the present invention.

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Below, an image forming device of a first preferred embodiment of the present invention will be described referring to the drawings.

FIG. 1 is a cross-sectional view showing the structure of the main portions of a printer of the present embodiment. As shown in FIG. 1, a printer (image forming device) 1 is connected to a terminal device (omitted in the drawing) made of one or a plurality of personal computers or the like, via a network such as LAN (Local Area Network), the Internet, or the like. The printer 1 includes a print function that prints and outputs a color or a black and white image corresponding to image data that come from the terminal device. In addition, in the description below, as a matter of convenience, the right side of the drawing will be referred to as the front side of printer 1, and the left side of the drawing will be referred to as the rear side of printer 1.

The printer 1, as shown in FIG. 1, includes a photosensitive drum (an example of an image carrier) 10, a charged roller 11, an exposure unit 12, a developing unit 13, a toner storage unit 14, a toner supply unit 15, a fixing unit 16, and a drum cleaning unit 17. An electrostatic latent image is formed on the surface of the photosensitive drum 10. The charged roller 11 uniformly charges the surface of the photosensitive drum 10 with a predetermined potential. The exposure unit 12 irradiates laser light on the surface of the photosensitive drum 10 based on the image data and forms the electrostatic latent image. The developing unit 13 performs developing by attaching toner to the electrostatic latent image formed on the surface of the photosensitive drum 10. The toner storage unit 14 stores toner to be supplied to the developing unit 13. The toner supply unit 15 supplies toner stored in the toner storage unit 14 to the developing unit 13. The fixing unit 16 fixes toner transferred on the recording paper to the recording paper. The drum cleaning unit 17 removes attachments such as toner and the like remaining on the surface of the photosensitive drum 10.

In addition, printer 1 includes an intermediate transfer belt 18, a driven roller 19 and a driving roller 20, a first transfer roller 21, a second transfer roller 22, and a belt cleaning unit 23, all of which are part of a transfer unit. Images corresponding to four kinds of toners described later are formed on the surface of the photosensitive drum 10 are overlapped and transferred to the intermediate transfer belt 18. The driven roller 19 and the driving roller 20 engage with the under surface (or the surface on the other side of the side on which an image is transferred) of the intermediate transfer belt 18 and at the same time move the intermediate transfer belt 18 in a direction shown by arrow A shown as a solid line. The first transfer roller 21 is pressed against the photosensitive drum 10 through the intermediate transfer belt 18 and at the same time transfers the toner image formed on the surface of the photosensitive drum 10 onto the surface of the intermediate transfer belt 18. The second transfer roller 22 comes into contact with the driving roller 20 through the intermediate transfer belt 18 and at the same time transfers the toner image formed on the surface of the intermediate transfer belt 18 onto the recording paper. The belt cleaning unit 23 removes attachments such as toner and the like remaining on the surface of the intermediate transfer belt 18.

Furthermore, the printer 1 is configured such that a plurality of sheets of recording papers that are in a stack can be stored, and at the same time having a paper feeding unit 24 that supplies recording papers one sheet at a time, a conveying unit 25 that conveys the recording papers supplied from the paper feeding unit 24, and a discharging unit 26 that discharges the recording papers with toner images formed thereon while being conveyed by the conveying unit 25.

The photosensitive drum 10 is arranged to be able to rotate freely near the center of the interior of the device, and the rotation shaft thereof extends in a direction horizontal to the installation surface of the device looking from the front side of the device, or the direction perpendicular to the paper surface. The photosensitive drum 10 is being driven to rotate by a photosensitive drum driving unit 72 shown in FIG. 6.

Referring to FIG. 1, the charged roller 11 is arranged above the photosensitive drum 10 and in a position near the photosensitive drum 10. Then, when a predetermined magnitude of potential is applied to the charged roller 11, the surface of the photosensitive drum 10 is uniformly charged by the electrical discharge of the charged roller 11.

The exposure unit 12 is arranged above the photosensitive drum 10 and more to the rear side than the rotation shaft of the developing unit 13, and configured to irradiate laser light from a semiconductor laser (omitted in the drawing) towards the photosensitive drum 10, based on the image data transmitted from the terminal device that is connected to the printer 1. In addition, the printer 1 includes a reflection mirror 27 arranged within the light path of the laser light from the exposure unit 12 to the photosensitive drum 10. Then, as shown by the dashed lines in FIG. 1, an electrostatic latent image is formed on a portion that is irradiated by the laser light on the photosensitive drum 10, through the laser light emitted from the exposure unit 12 irradiating on the photosensitive drum 10 after being reflected in a predetermined angle by the reflection mirror 27.

The developing unit 13 is formed in a cylinder shape, and arranged adjacent to the photosensitive drum 10 and at the same time at the rear side of the photosensitive drum 10. In addition, the developing unit 13 includes a rotation frame 28 that extends radially from the rotation shaft at a 90 degree interval, and a cyan developing machine 13*a*, a magenta developing machine 13*b*, a yellow developing machine 13*c*, and a black developing machine 13*d*, each storing toners in each colors of the cyan, magenta, yellow, and black colors and at the same time being supported by the rotation frame 28. In addition, the cyan developing machine 13*a*, the magenta developing machine 13*b*, the yellow developing machine 13*c*, and the black developing machine 13*d* are each arranged in the four compartments, which are four equal parts divided in the circumference direction of the developing unit 13 by the rotation frame 28. Then, this rotation frame 28 is formed to be able to rotate freely around the shaft parallel to the rotation shaft of the photosensitive drum 10, and is driven by a driving unit (the developing unit driving unit 71 in FIG. 6) made of a motor, a gear, or the like. This way, the developing unit 13 is able to rotary rotate around the shaft parallel to the rotation shaft of the photosensitive drum 10.

In addition, one-component nonmagnetic toner is stored in the cyan developing machine 13*a*, the magenta developing machine 13*b*, and the yellow developing machine 13*c*. In addition, one-component magnetic toner is stored in the black developing machine 13*d*. Then, developing is performed by the rotation of the developing unit 13, and the attachment of toner stored in each of the developing machines 13*a* to 13*d* to the electrostatic latent image formed on the surface of the photosensitive drum 10.

In the toner storage unit 14, four toner cartridges (omitted in the drawing) that store toner of colors corresponding to each of the developing machines 13*a* to 13*d* are mounted lined up in a direction horizontal to the installation surface of the device looking from the front side of the device, or a direction perpendicular to the paper surface, and each of the four toner cartridges is configured to be able to be taken out from the front side of the device.

The toner supply unit 15 is configured to supply each of the four colors of toner stored in each of the toner cartridges of the toner storage unit 14 to each of the developing machines 13*a* to 13*d* corresponding to the color of the toner.

The drum cleaning unit 17 is arranged on the front side and adjacent to the photosensitive drum 10, and at the same time above the intermediate transfer belt 18. At the same time, the drum cleaning unit 17 includes a polishing roller in which attachments such as toner and the like remaining on the surface of the photosensitive drum 10 are removed by the polishing roller. The drum cleaning unit 17, especially the polishing roller, is driven by the drum cleaning unit driving unit 75 shown in FIG. 9.

Referring again to FIG. 1, the intermediate transfer belt 18 is arranged below the photosensitive drum 10 and the toner storage unit 14, and is arranged to extend around and between and pulled in tension by the driven roller 19 and the driving roller 20 that engage with the under surface of the intermediate transfer belt 18. In addition, the first transfer roller 21 is arranged below the photosensitive drum 10 and in a position opposite the photosensitive drum 10 through the intermediate transfer belt 18, and pressed against the photosensitive drum 10. The intermediate transfer belt 18 is configured to turn by the rotation of the driving roller 20 driven by the intermediate transfer belt driving unit 73 shown in FIG. 6.

The second transfer roller 22 is arranged below the driving roller 20 and in a position opposite the driving roller 20 through the intermediate transfer belt 18, and pressed against the intermediate transfer belt 18. During the print operation, when a recording paper passes a nip portion formed in between the driving roller 20 and the second transfer roller 22, the toner image formed on the surface of the intermediate transfer belt 18 is transferred onto the recording paper.

The paper feeding unit 24 includes a paper feeding cassette 30 that has a lift plate 29 on which a plurality of sheets of recording papers are placed, and a paper feeding roller 31 that is in contact with recording papers that are placed on the lift plate 29 and at the same time launches out recording papers from the paper feeding cassette 30. Then, the paper feeding cassette 30 is configured such that it can be taken out from the front side of the printer 1.

The conveying unit 25 is arranged in between the paper feeding unit 24 and the discharging unit 26. The conveying unit 25 is made of a first conveying path 32 that extends from the paper feeding unit 24 to the second transfer roller 22, a second conveying path 33 that extends from the second transfer roller 22 to the fixing unit 16, and a third conveying path 34 that extends from the fixing unit 16 to the discharging unit 26. In addition, a branching claw 35 is arranged at the downstream side of the fixing unit 16 in the third conveying path 34 and at the same time a return conveying path 36 is arranged below the second conveying path 33 to return a recording paper that has passed through the fixing unit 16 back to the first conveying path 32 via this branching claw 35, in a two-sided printing mode.

In the conveying unit 25, in each of the first to the third conveying paths 32, 33, and 34, a guide plate and a roller pair (all omitted in the figure) are arranged that convey while guiding the recording paper. In addition, in the first conveying path 32, a conveying roller 37 that conveys the recording paper fed from the paper feeding cassette 30 toward a resist roller 38, and the resist roller 38 made of a pair of rollers that corrects the orientation of the recording paper that passed through the conveying roller 37 and at the same time adjusts the conveying timing of the recording paper are arranged. Then, the first conveying path 32 is made of a curved path 39 formed along the conveying roller 37, and a straight path 40 that extends from the curved path 39 to the second transfer roller 22.

The second conveying path 33 is formed approximately straight, and extends in a direction horizontal to the installation surface of the printer 1, from the front side of the printer 1 toward the rear side. In addition, the portion of the third conveying path 34 that extends from the fixing unit 16 to the branching claw 35 is formed approximately straight, and extends in a direction horizontal to the installation surface of the printer 1 from the front side of the printer 1 toward the rear side, and at the same time the portion that extends from the branching claw 35 to the discharging unit 26 extends in a direction perpendicular to the installation surface of the printer 1 and towards the upper portion of the printer 1.

Furthermore, the return conveying path 36 branches off downward from the portion in which the branching claw 35 is arranged in the third conveying path 34, and at the same time extends in a direction horizontal to the installation surface of the printer 1 from the rear side toward the front side of the printer 1 below the fixing unit 16, the second conveying path 33, the second transfer roller 22, and the resist roller 38. Then, this return conveying path 36 comes close to the resist roller 38 in the straight path 40 of the first conveying path 32 and is continuous with it on the upstream side. In addition, also in the return conveying path 36, a guide plate and a roller pair (all omitted in the drawing) are arranged to convey guiding the recording papers, same as the first to the third conveying paths 32, 33, and 34.

In addition, the discharging unit 26 is formed on the upper surface of the printer 1. The recording paper that has passed through the fixing unit 16 is sent out to the exterior of the printer 1 passing through the third conveying path 34, and discharged on the discharging unit 26.

In addition, the printer 1, at appropriate places although not shown in FIG. 1, is made of a central processing unit (control unit) 6 (hereinafter referred to as CPU (Central Processing Unit) as shown to FIG. 6) that controls the operations of the entire device, a memory that includes ROM (Read Only Memory) in which various control programs and the like are stored and RAM (Random Access Memory) that is used as a work area and the like of the CPU 6, a motor that makes various rollers such as the charged roller 11, the driving roller 20, the first transfer roller 21, the second transfer roller 22, the resist roller 38 and the like, the photosensitive drum 10, the developing unit 13, and the like rotate, and a power unit that supplies electrical power to each units of the exposure unit 12, the toner supply unit 15, the fixing unit 16, the drum cleaning unit 17, the belt cleaning unit 23 and the like, and the motor.

Next, the print operation of the above described printer 1 will be described. Through the CPU 6, image data can be accepted via the network from the terminal device (not shown in the figure) that is connected to be able to communicate with printer 1, and is stored in the RAM. Then, via the CPU 6, image data are read out from the RAM, and based on the control signal outputted from the CPU 6, operations of each unit and the like of the printer 1 are controlled, and thus, each process of the electrification process, exposure process, developing process, first transfer process, second transfer process, and the fixing process are executed in order.

First, in the electrification process, the surface of the photosensitive drum 10 is uniformly charged to a predetermined potential by the electrical discharge of the charged roller 11. In addition, next, in the exposure process, laser light is irradiated on the photosensitive drum 10 via the semiconductor laser (omitted in the figure) of the exposure unit 12. Further, by the scanning of the laser light reflected in a predetermined angle via the reflection mirror 27 on the photosensitive drum 10, the power voltage of the portion irradiated by the laser light on the surface of the photosensitive drum 10 changes, and an electrostatic latent image is formed on this portion.

Next, in the developing process, by providing toner via each of the developing machines 13*a* to 13*d* of the developing unit 13 on the portion on which the electrostatic latent image is formed on the surface of the photosensitive drum 10, the developing of the toner image is carried out on the surface of the photosensitive drum 10.

Then, in the first transfer process, the toner image formed on the surface of the photosensitive drum 10 is transferred onto the surface of the intermediate transfer belt 18 driven at a predetermined speed. During this time, the toner image formed on the surface of the photosensitive drum 10 is overlapped and transferred onto the surface of the intermediate transfer belt 18 in a predetermined timing for each color of the toner, and an image is formed of the plurality of colors on the surface of the intermediate transfer belt 18.

In addition, after the first transfer process terminates, attachments such as toner and the like remaining on the surface of the photosensitive drum 10 are scraped off from the surface of the photosensitive drum 10 via the drum cleaning unit 17, and recovered to a recovery unit (omitted in the figure).

Until the next process, which is the second transfer process begins, the recording paper sent out from the paper feeding cassette 30 via the rotation of a paper feeding roller 31 is conveyed toward the conveying roller 37, and passes through the curved path 39 of the first conveying path 32. The recording paper that passed through the curved path 39 of the first conveying path 32 passes through the straight path 40 of the first conveying path 32 and is conveyed to the resist roller 38. The orientation of the recording paper is corrected at this resist roller 38 and at the same time, after adjusting the conveying timing, conveyed toward the nip portion in between the driving roller 20 and the second transfer roller 22.

After that, in the second transfer process, when a power voltage of the opposite potential to the toner charged to a predetermined potential attached on the surface of the intermediate transfer belt 18 is applied to the second transfer roller 22, electrostatic force occurs corresponding to the difference in the electrical potential between the toner charged to a predetermined potential attached on the surface of the intermediate transfer belt 18 and the second transfer roller 22, and the toner image formed on the surface of the intermediate transfer belt 18 transfers onto the recording paper that passes through the nip portion in between the driving roller 20 and the second transfer roller 22. Then, the recording paper with the toner image transferred thereon in the second transfer process passes through the second conveying path 33 and is conveyed toward the fixing unit 16.

In addition, after the second transfer process terminates, attachments such as toner and the like attached on the surface of the intermediate transfer belt 18 is scraped off by the belt cleaning unit 23 and at the same time is recovered to the recovery unit (omitted in the figure).

Next, in the fixing process, the fixing unit 16 heats and applies pressure to the toner image on the recording paper to fix the toner image on the recording paper. The recording paper on which the toner image is fixed in the fixing process passes through the third conveying path 34, and after passed through the place where the branching claw 35 is arranged, it is sent out to the exterior of the printer 1 and discharged to the discharging unit 26.

Figure 2:
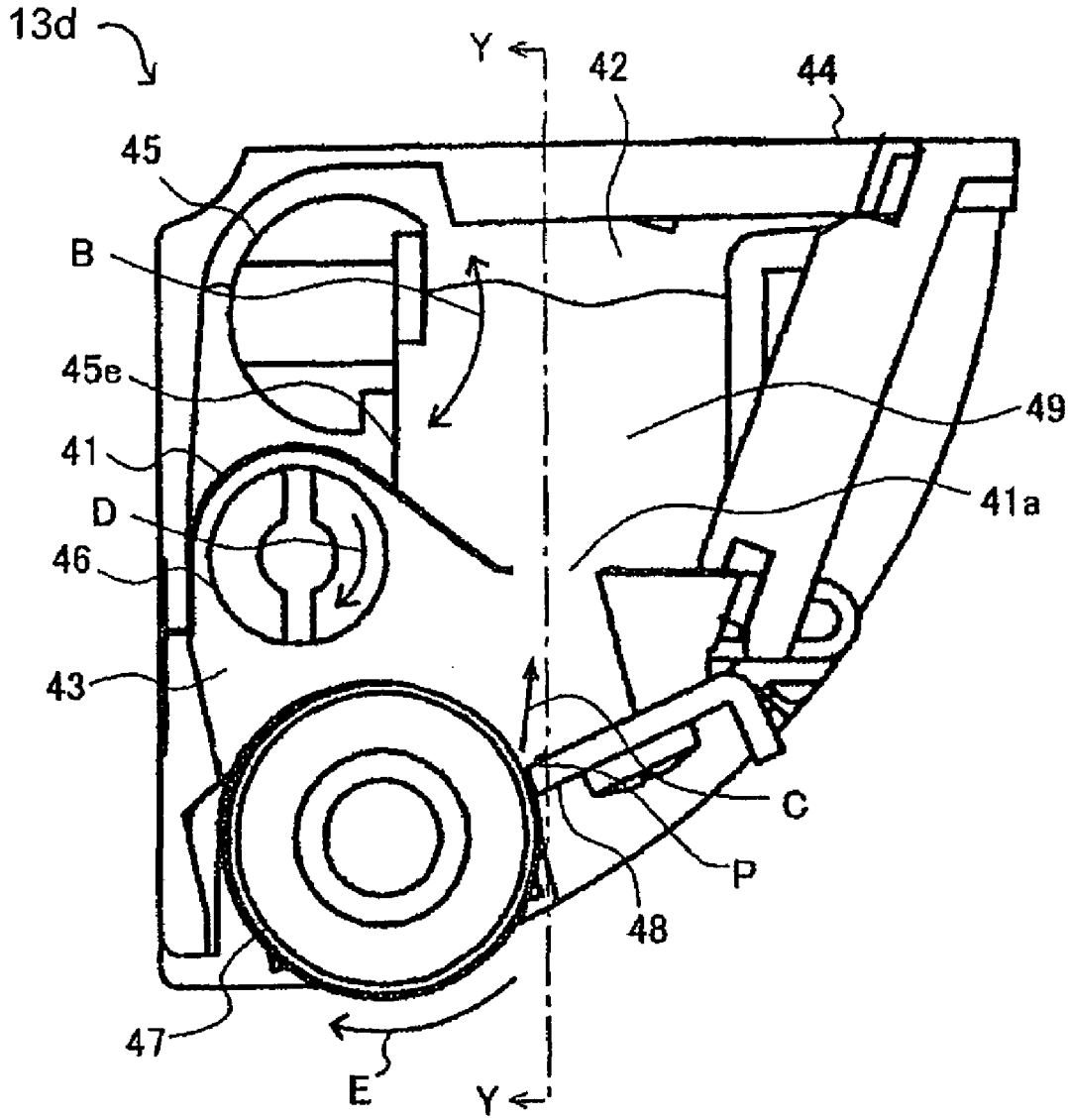
FIG. 2 is a side cross-sectional view showing an example of the structure of a black developing machine of the printer of FIG. 1.
Figure 3:
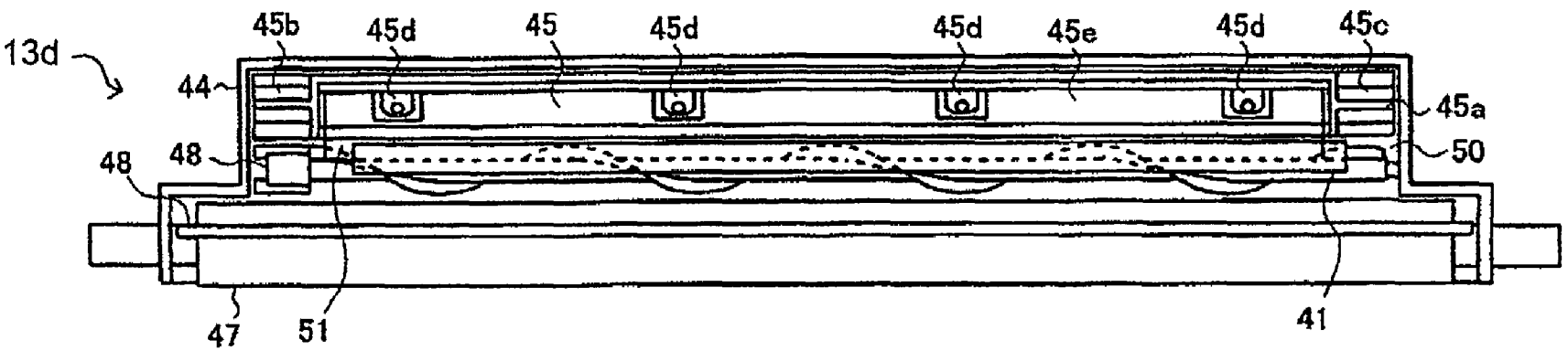
FIG. 3 is a longitudinal cross-sectional view of the section taken at YY of the black developing machine shown in FIG. 2.
Figure 4:
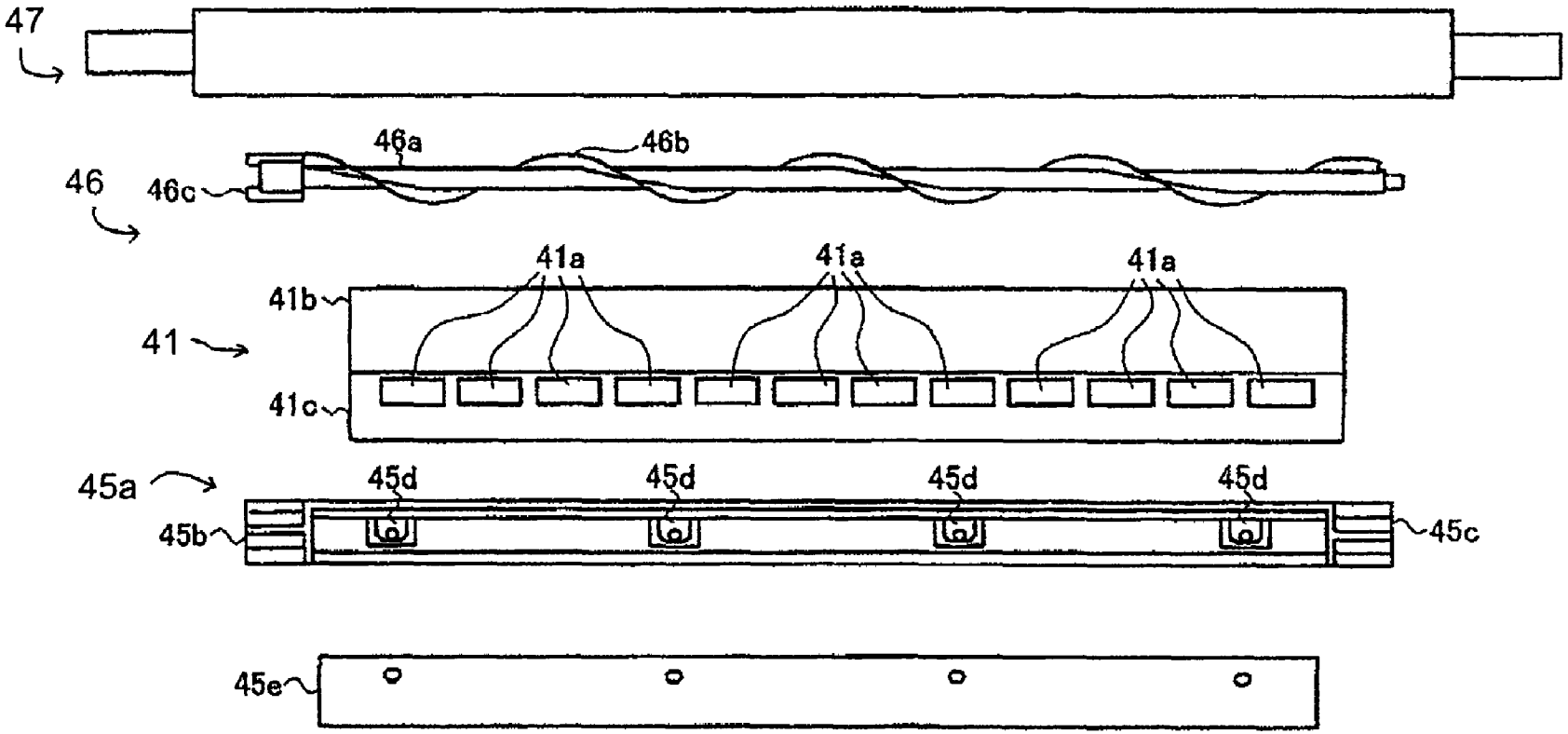
FIG. 4 is an exploded view showing an example of members that constitute the main portions of the black developing machine.

Next, an example of the configuration of the black developing device 13*d* is described using FIGS. 2 to 4. FIG. 2 is a side cross-sectional showing an example of the configuration of the black developing machine 13*d*. FIG. 3 is a side cross-sectional of the section at YY of the black developing machine 13*d* shown in FIG. 2. FIG. 4 is a development or exploded view showing an example of the main configuration members in the black developing machine 13*d*. In addition, in the following description, as a matter of convenience, one-component magnetic toner will be simply referred to as magnetic toner.

As shown in FIG. 2, the black developing machine 13*d* includes a chassis 44, a divider 41, a first toner chamber 42 and a second toner chamber 43, and a mixing paddle 45. The chassis 44 stores each configuration member of the black developing machine 13*d*. The divider 41 forms a first toner chamber 42 and a second toner chamber 43 to be described later that are continuous with each other at two end portions in the longitudinal direction thereof. The divider 41 has a plurality of rectangular openings 41*a* forming the flow path of the magnetic toner 49 of the black color arranged therein. The first toner chamber 42 and the second toner chamber 43 are continuous with each other at two end portions in the longitudinal direction thereof and have magnetic toner 49 stored therein. The mixing paddle 45 mixes the magnetic toner 49 stored in the first toner chamber 42 and at the same time makes the magnetic toner 49 go through the toner flow path 50 (rear side of the paper surface in FIG. 2) out of the two toner flow paths 50 and 51 shown in FIG. 3 between the two end portions in the longitudinal direction of the divider 41 and the chassis 44 of the black developing machine 13*d*. Further, the mixing paddle 45 conveys the magnetic toner 49 in the first toner chamber 42 to the second toner chamber 43.

Furthermore, the black developing machine 13*d* includes a screw 46, a blade 48, and a developing roller 47. The screw 46 is a mixing member that mixes the magnetic toner 49 stored in the second toner chamber 43 and at the same time conveys the magnetic toner 49 in the second toner chamber 43 to the first toner chamber 42 from the toner flow path 51 shown in FIG. 3 and each of the openings 41*a* of the divider 41. The blade 48 removes excess magnetic toner 49 from the magnetic toner 49 attached on the surface of the developing roller 47 to be described later and evenly thins down the magnetic toner 49 attached on the surface of the developing roller 47 to a predetermined thickness. The developing roller 47 attaches the magnetic toner 49 and supplies the magnetic toner 49 with a thickness to a predetermined even thickness via the blade 48 to the surface of the photosensitive drum 10.

The divider 41 in the longitudinal direction thereof is shorter than the mixing paddle 45 and the screw 46 in the longitudinal direction, and arranged in a position in between the mixing paddle 45 and the screw 46. By arranging the divider 41 in this position, the interior of the black developing machine 13*d* is divided into the first toner chamber 42 and the second toner chamber 43, and at the same time toner flow paths 50 and 51 are formed between the two end portions of the divider 41 in the longitudinal direction and the chassis 44.

In addition, the divider 41, as shown in FIG. 4, includes a curved portion 41*b* arranged such that the screw 46 is separated from it by a predetermined distance to the side of the developing roller 47, and a flat portion 41*c* on which a plurality of, 12 in this embodiment, rectangular openings 41*a* is arranged. In addition, in the flat portion 41*c* of the divider 41, the 12 rectangular openings 41*a* are arranged in positions opposite a removing position P at which excess magnetic toner 49 attached on the developing roller 47 is removed via the blade 48. More specifically, each opening 41*a* of the divider 41 is arranged in a position in which the magnetic toner 49 removed from the developing roller 47 by the blade 48 flows, moving in a direction shown by arrow C in solid line to the first toner chamber 42, affected by the force to move in the direction shown by arrow C in solid line by the removing thereof via the blade 48 and by the mixing force of the screw 46 to the outer circumference direction.

In the chassis 44 of the black developing machine 13*d*, a supply inlet (omitted in the figure) is arranged in which fresh magnetic toner 49 is supplied from the toner supply unit 15 to the interior of the first toner chamber 42. This supply inlet (omitted in the figure) is arranged in a position such that the magnetic toner 49 supplied from the toner supply unit 15 will not be supplied directly above the openings 41*a* of the divider 41 and the toner flow paths 50 and 51.

The mixing paddle 45 is arranged in the first toner chamber 42 as shown in FIGS. 2 to 4, and made of a rotation shaft 45*a* that has resin, and a feather member 45*e* that is mounted to mounting portions 45*d* to be described later of the rotation shaft 45*a*. In addition, on the rotation shaft 45*a* of the mixing paddle 45, gears 45*b* and 45*c* on the two end portions of the mixing paddle 45 in the longitudinal direction, and the mounting portions 45*d* to mount the feather member 45*e* made of pet resin that is able to change freely the shape thereof between gear 45*b* and gear 45*c* are formed. In addition, by configuring the mixing paddle 45 this way, the ability to convey the magnetic toner 49 in the longitudinal direction of the mixing paddle 45 lowers, meanwhile, the ability to mix the magnetic toner 49 improves.

Then, by transmitting the driving force of a motor (omitted in the figure) to the gears 45*b* and 45*c* via a gear or the like (omitted in the figure), the mixing paddle 45 reciprocates with the rotation shaft 45*a* as the center in the direction shown by an arrow B depicted as a solid line shown in FIG. 2. With the reciprocation of the mixing paddle 45 in the direction shown by the arrow B in solid line, the fresh magnetic toner 49 supplied from the toner supply unit 15 to the interior of the first toner chamber 42 and the magnetic toner 49 that already exists (including the magnetic toner 49 that has passed through each of the openings 41*a* of the divider 41 and the toner flow path 51 from the second toner chamber 43 into the interior of the first toner chamber 42) in the interior of the first toner chamber 42 are mixed, and at the same time, the mixed magnetic toner 49 passes through the toner flow path 50 and is conveyed to the second toner chamber 43.

The screw 46, as shown in FIGS. 2 to 4, is made in between the developing roller 47 and the divider 41. In addition, the screw 46 is formed collectively from resin, and a spiral 46*b* is arranged on the outer circumference of the rotation shaft 46*a* thereof and a gear 46*c* is arranged on one end of the shaft of the rotation shaft 46*a*. In addition, here, the pitch of the spiral 46*b* (or one round of the rotation shaft 46*a* of the spiral 46*b*) is set to be three times that of the diameter in between the tips of the spiral 46*b* in the circumference direction of the rotation shaft 46*a*, to lower the conveying ability of the screw 46 in the longitudinal direction and to improve the ability of conveying the magnetic toner 49 in the circumference direction of the screw 46.

Then, by transmitting the driving force of a motor (omitted in the figure) to the gear 46*c* via a gear or the like (omitted in the figure), the screw 46 rotates in the direction shown by arrow D in the solid line shown in FIG. 2. The screw 46 rotates in the direction shown by arrow D in the solid line, and thus, mixes the magnetic toner 49 supplied from the first toner chamber 42 to the interior of the second toner chamber 43, the magnetic toner 49 removed from the developing roller 47 via the blade 48, and the magnetic toner 49 already existing in the interior of the second toner chamber 43. In addition, the screw 46 conveys the mixed magnetic toner 49 in the direction to the toner flow path 51. Furthermore, the screw 46 conveys it to the first toner chamber 42 passing through the toner flow path 51, and at the same time, makes the magnetic toner 49 in the interior of the second toner chamber 43 pass through each of the openings 41*a* of the divider 41 and conveys it to the first toner chamber 42.

The developing roller 47, as shown in FIGS. 1 to 4, is arranged in the chassis 44 of the black developing machine 13*d*, and a portion on the outer circumference thereof is exposed at the second toner chamber 43. The developing roller 47 is configured to contact the photosensitive drum 10 when the black developing machine 13*d* is rotated to a position opposite the photosensitive drum 10. In addition, the outer circumference portion of the developing roller 47 is preferably made of aluminum, and a plurality of magnets (omitted in the figure) is arranged in between the rotation shaft of the developing roller 47 and the outer circumference portion thereof. Then, by transmitting the driving force of a motor (omitted in the figure) to a gear (omitted in the figure) of the developing roller 47 via a gear and the like (omitted in the figure) in the developing operation, the developing roller 47 rotates in a direction shown by arrow E in solid line shown in FIG. 2. Then, a predetermined electrical potential is applied to the developing roller 47 from a power unit (omitted in the figure), and magnetic toner 49 is attached onto the surface of the developing roller 47. Furthermore, excess magnetic toner 49 is removed by the blade 48 by the rotation of the developing roller 47 in the direction shown by arrow E in solid line. The developing of a toner image is carried out such that the magnetic toner 49 attached uniformly in a predetermined thickness on the surface of the developing roller 47 is supplied via the developing roller 47 to the electrostatic latent image formed on the photosensitive drum 10.

Next, the circulation operation of the magnetic toner 49 in the black developing machine 13*d* will be described. In the black developing machine 13*d*, as shown in FIGS. 1 to 3, fresh magnetic toner 49 supplied from the toner supply unit 15 to the first toner chamber 42 is mixed with the already existing magnetic toner 49 (including the magnetic toner 49 that has passed through each of the openings 41*a* of the divider 41 and the toner flow path 51 from the second toner chamber 43 to the interior of the first toner chamber 42) in the interior of the first toner chamber 42 via the mixing paddle 45. Then, via the mixing paddle 45, the mixed magnetic toner 49, while further being mixed, passes through the toner flow path 50 and is conveyed to the second toner chamber 43.

The magnetic toner 49 conveyed to the second toner chamber 43 is mixed with the already existing magnetic toner 49 (including the magnetic toner 49 removed from the developing roller 47 via the blade 48) in the interior of the second toner chamber 43 via the screw 46. A portion of the mixed magnetic toner 49 is conveyed toward the toner flow path 51 while being mixed, via the screw 46, and passes through the toner flow path 51 and is conveyed to the first toner chamber 42. In addition, a portion of the mixed magnetic toner 49 attaches to the developing roller 47 to which a voltage of a predetermined potential is applied. Then, the developing roller 47 rotates in a direction shown by the arrow E shown as a solid line. Excess magnetic toner 49 is removed from the magnetic toner 49 attached to the developing roller 47 via the blade 48. Since a plurality of openings 41*a* is arranged on the divider 41, the magnetic toner 49 removed from the developing roller 47 by the blade 48 will not be pressed against and clot to the inner wall of the divider 41 and the chassis 44 and the like, and will pass through each of the openings 41*a* of the divider 41 and be conveyed to the first toner chamber 42 by the force to the direction shown by arrow C in solid line via the removing thereof by the blade 48 and the mixing force to the outer circumference direction of the screw 46.

Figure 5:
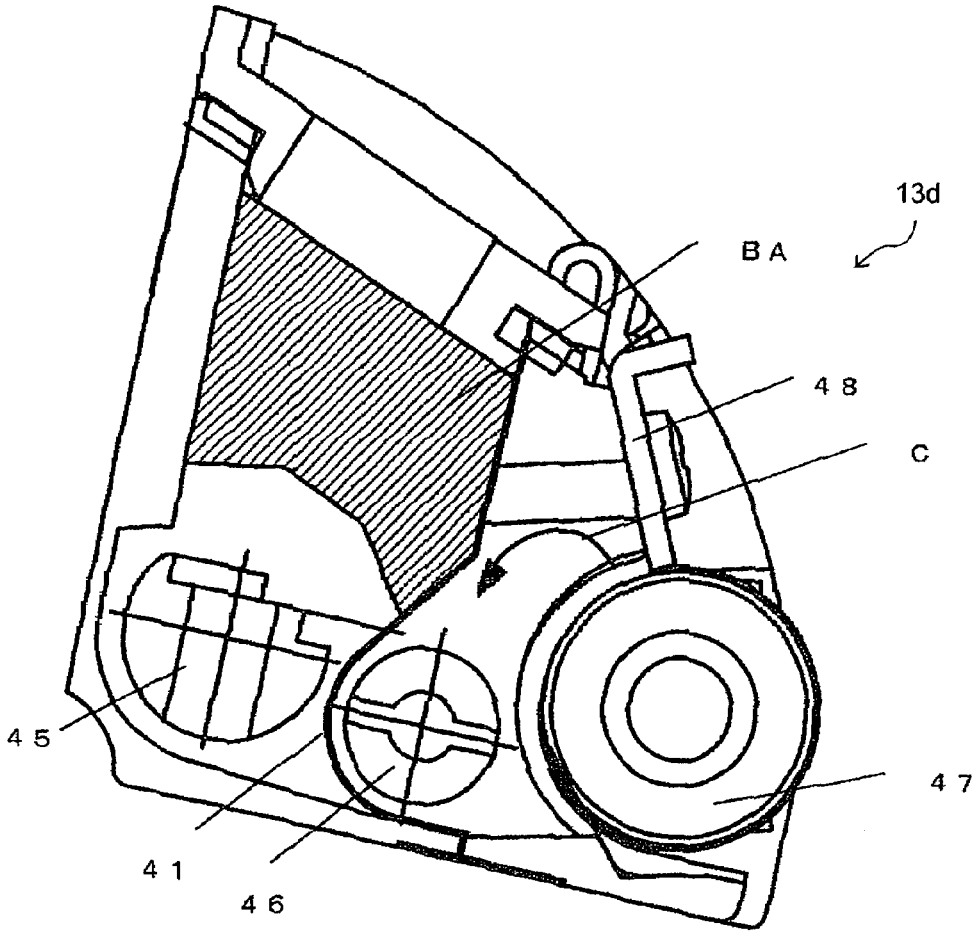
FIG. 5 is a side cross-sectional view showing an example of an accumulation position of toner in the interior of the black developing machine when printing in black and white.

FIG. 5 is a cross-sectional view showing an example of an accumulation position of toner in the interior of the black developing machine 13*d* during printing in black and white. As described above, toner is affected by a force that results from it being removed by the blade 48 to the direction shown by arrow C in solid line and the mixing force of the screw 46 to the outer circumference direction. However, toner may accumulate in the region BA which is more than a predetermined distance away from the mixing paddle 45 on the left side of the divider 41 because the mixing effect is not sufficient. In addition, in the case that toner stored in the interior of the black developing machine 13*d* is crushed toner, the accumulation of toner even more easily occurs due to the irregular shape in the shape of the toner particles. On the contrary, in the case with polymerized toner, the accumulation of toner becomes less likely to happen, due to the approximately spherical form of the shape of the toner particles. The printer 1 of the present invention executes a toner discharge process to discharge toner accumulated in the region BA.

Figure 6:
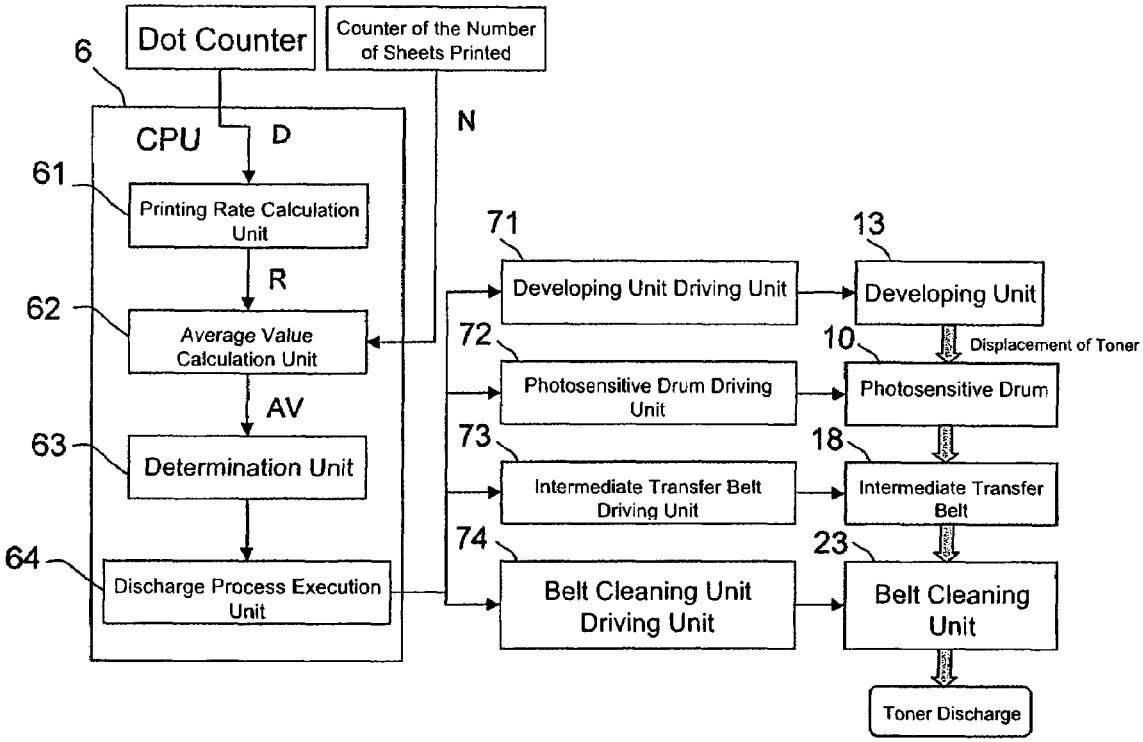
FIG. 6 is a view of a block diagram showing the configuration of the main portions of the printer according to the first preferred embodiment of the present invention.

FIG. 6 is a view of a block diagram showing an example of the function configuration of the CPU 6. The CPU 6 functionally includes a printing rate calculation unit 61, an average value calculation unit 62, a determination unit 63, and a discharge process execution unit 64. Here, the CPU 6 functions as the function units of the printing rate calculation unit 61, the average value calculation unit 62, the determination unit 63, the discharge process execution unit 64, and the like, by reading out and executing programs stored in advance in the ROM and the like. The printer 1 includes a dot counter and a counter of the number of sheets printed. Hereinafter, the count values of the dot counter and the counter of the number of sheets printed are indicated by "D" and "N" respectively.

In addition, data that can be stored in a recording medium being able to be internally configured (in a personal computer or the like) with various data stored in RAM, ROM, or the like, can be configured such that it can be read by the driver of, for example, a hard disk, optical disk, flexible disk, silicon disk, cassette media scanner, or the like. In such a case, the recording medium is, for example, a hard disk, optical disk, flexible disk, CD, DVD, semiconductor memory, or the like.

The printing rate calculation unit 61 (an example of a printing rate calculation unit) obtains a printing rate R, when forming a black and white toner image on a recording paper. Here, the printing rate R is calculated using (1) below, for example. More specifically, the printing rate R shows the percentage of the black toner being attached, and since the smaller the printing rate R the lower the amount of toner is being consumed, it becomes easier for toner to accumulate (refer to FIG. 5) in the interior of the black developing machine 13*d*.

$$(\text{Printing rate } R)=(\text{Number of dots } D \text{ that toner is being attached})/(\text{Entire number of dots } D0)\times 100 \quad (1)$$

The average value calculation unit 62 (an example of an average value calculation unit) is configured to calculate the average printing rate AV, which is the average value of the printing rate R of every predetermined number of sheets N0 (here, 50 sheets), when black and white images are being formed continuously for at least a predetermined number of sheets N0 (here, 50 sheets) on the recording papers. More specifically, it is configured to calculate the average printing rate AV by the equation (2) below.

$$(\text{Average printing rate } AV)=\Sigma R/N0 \quad (2)$$

However, ΣR is the sum of each of the printing rates R of the predetermined number of sheets N0. The determination unit 63 (an example of a determination unit) determines whether or not to execute the toner discharge process based on the average printing rate AV. More specifically, the determination unit 63 determines to execute the toner discharge process when the average printing rate AV obtained by the average value calculation unit 62 is below a predetermined value AV0 (for example, 3%) that is set in advance.

The discharge process execution unit 64 (an example of a discharge process execution unit) is configured to form and to discharge a black toner image on the photosensitive drum 10 via the black developing machine 13*d*. In other words, the discharge process execution unit 64 is configured to control the developing unit 13. In addition, the discharge process execution unit 64 makes the toner image formed on the surface of the photosensitive drum 10 transfer onto the surface of the intermediate transfer belt 18, and at the same time, through the belt cleaning unit 23, discharges toner attached on the surface of the intermediate transfer belt 18.

Figure 7:
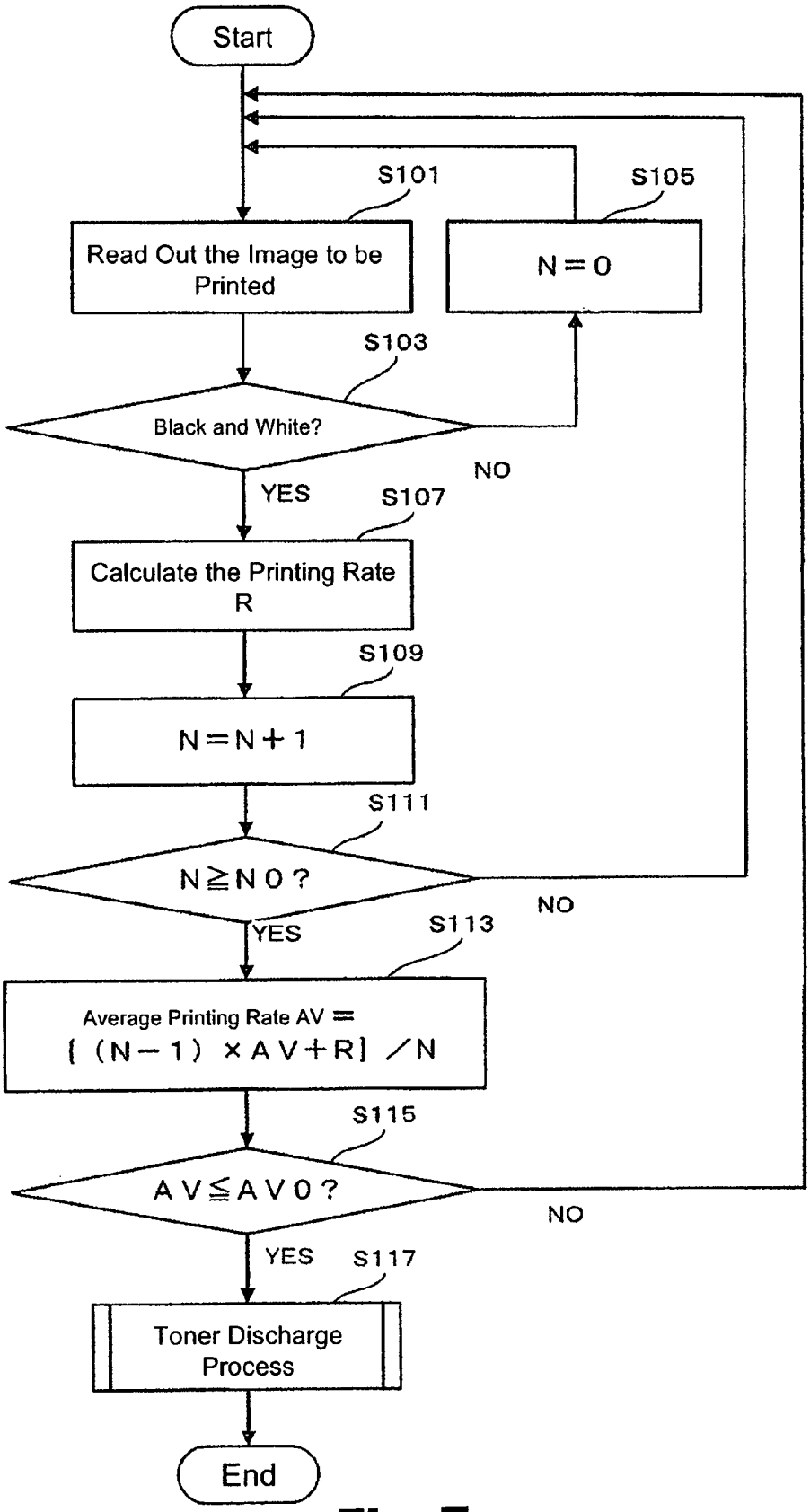
FIG. 7 is a view of a flowchart showing an example of a toner discharge operation of the printer executed by the CPU shown in FIG. 6.

FIG. 7 is a view of a flowchart showing an example of the toner discharge operation of the printer 1 executed by the CPU 6. Here, the default setting of the count value N and the average printing rate AV of the counter that counts the number of sheets of the continuous black and white printing are set to be zero. First, the image data acquired from the terminal device are read out from RAM via the printing rate calculation unit 61 (S101). Then, the printing rate calculation unit 61 determinates whether it is a black and white printing or a color printing (S103). When determined that it is a color printing (No for S103), the count value N is reset to zero (S105), and the process returns to Step S101. When determined that it is a black and white printing (Yes for S103), the printing rate R is calculated via the printing rate calculation unit 61 (S107).

Then, the count value N is incremented by only 1 via the average value calculation unit 62 (S109), and a determination is made (S111) on whether or not the count value N is equal to or greater than a predetermined number of sheets N0 (here, 50 sheets). When it is determined that the count value N is less than the predetermined number of sheets N0 (No for S111), the process returns to Step S101. When it is determined that the count value N is equal to or greater than the predetermined number of sheets N0 (Yes for S111), the average printing rate AV is updated (S113) using the formula (3) below.

$$(\text{Average printing rate } AV)=\{(N-1)\times AV+R\}/N \quad (3)$$

Next, a determination is made (S115) on whether or not the average printing rate AV is equal to or less than a predetermined value AV0 (here, 3%) set in advance, via the determination unit 63. When it is determined that the average printing rate AV is greater than the predetermined value AV0 (No for S115), the process returns to Step S101. When it is determined that the average printing rate AV is equal to or less than the predetermined value AV0 (Yes for S115), the toner discharge process will be executed (S117) via the discharge process execution unit 64, and the process terminates.

Figure 8:
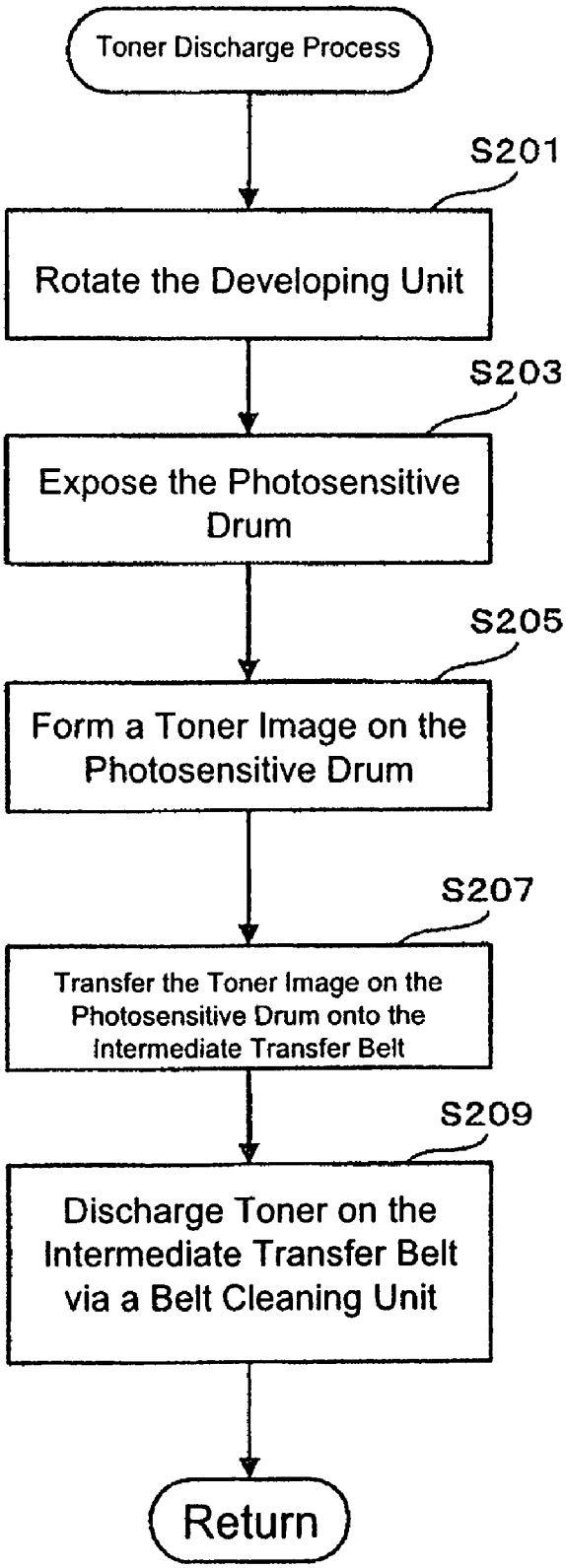
FIG. 8 is a view of a detailed flowchart of the toner discharge process that is executed in Step S117 of the flowchart shown in FIG. 7.

FIG. 8 is a view of a detailed flowchart of the toner discharge process that is executed in Step S117 of the flowchart shown in FIG. 7. In addition, the processes below are all executed by the discharge process execution unit 64. First, through the driving mechanism made of the motor of the developing unit 13 and the like, the developing unit 13 is rotated (this is defined herein as rotary rotated) only a predetermined number of times (here, rotate once) (S201). Then, with the black developing machine 13*d* in a state opposite the photosensitive drum 10, an electrostatic latent image is formed on the photosensitive drum 10 (S203) via the exposure unit 12. Next, a toner image is formed (S205) on the photosensitive drum 10 via the developing unit 13 (black developing machine 13*d*). Next, the toner image on the photosensitive drum 10 is transferred to the intermediate transfer belt 18 (S207). Then, the discharge process execution unit 64 drives the belt cleaning unit 23 via the belt cleaning unit driving unit 74 as shown in FIGS. 1 and 6, and discharges toner attached on the surface of the intermediate transfer belt 18 (S209). Then, the process is returned.

In this manner, when it is determined that the toner discharge process is to be executed, since toner discharge process is executed after the developing unit 13 is rotated (=rotary rotated) for only a predetermined number of times (here, once) that is set in advance, toner stored in the black developing machine 13*d* is mixed by the rotation (=rotary rotation) of the developing unit 13, and thus, it is possible to suppress the progression of the deterioration of toner.

In addition, since whether or not toner discharge process is to be executed is determined based on the average printing rate AV, it is possible to execute the toner discharge process at a more appropriate timing.

In addition, when the average printing rate AV is equal to or less than the predetermined value AV0 (here, 3%) that is set in advance, since it will be determined that the toner discharge process is to be executed, it is possible to determine the timing for executing the toner discharge process by a simple process.

In addition, since a black toner image is formed and discharged on the photosensitive drum 10 via the black developing machine 13*d*, it is possible to discharge accurately a desired amount of toner.

In addition, the toner image formed on the surface of the photosensitive drum 10 is transferred onto the surface of the intermediate transfer belt 18, and via the belt cleaning unit 23, since toner attached on the surface of the intermediate transfer belt 18 is discharged, it is possible to discharge toner with a simple configuration.

In this manner, according to the printer 1 of the present embodiment, when the determination unit determined that the toner discharge process is to be executed, the discharge process execution unit makes the rotary of the developing unit rotate for only a predetermined number of times that is set in advance before executing the toner discharge process. Therefore, it is possible to suppress the progression of the deterioration of toner because accumulated toner stored in the black developing machine is mixed by the rotary rotation of the developing unit.

More specifically, in a rotary type developing unit, when printing in black and white, the developing unit does not rotary rotate, and the developing machine that handles the black color is used in a state that it is motionless in a position opposite the photosensitive drum. Therefore, in this case, a portion of the toner stored in the developing machine that handles the black color may accumulate. However, it is possible to solve the problem of the accumulation and problems accompanying thereto by mixing the accumulated toner via the rotary rotation of the developing unit.

When the average printing rate is low, a state remains in which the amount of toner being consumed is small. Thus, the deterioration of toner stored in the developing machine progresses, and the possibility of a portion accumulating increases. Therefore, consequently, it is especially effective to determine whether or not to execute the toner discharge process based on the average printing rate.

Then, as with the present embodiment, the determination unit 63 is configured to determine to execute the toner discharge process when the average printing rate is equal to or less than a predetermined value that is set in advance, and thus it is possible to determine with a simple process the timing for executing the toner discharge process.

In addition, the printer 1 of the above described embodiment is configured to discharge toner via the black developing machine 13*d* forming a toner image on the photosensitive drum 10. According to this kind of configuration, it is possible to discharge accurately the desired amount of toner.

In addition, the printer 1 of the above described embodiment is configured such that toner image formed on the surface of the photosensitive drum 10 is transferred onto the surface of the intermediate transfer belt 18, and toner attached on the surface of the intermediate transfer belt is discharged via the belt cleaning unit 23. Therefore, it is possible to discharge toner with a simple configuration.

In addition, the present invention is applicable in the following configurations.

(A) In the above describe embodiment, a case in which the determination unit 63 determines whether or not to execute the toner discharge process based on whether or not the average printing rate AV is equal to or less than a predetermined value AV0 is described. However, a configuration can be such that the determination on whether the toner discharge process is to be executed is based on the count value N, which is the number of sheets for which black and white images are formed continuously on recording papers. In addition, the configuration can be that the determination unit 63 determines whether or not to execute the toner discharge process based on the printing rate R. In these cases, the process is simplified.

In the case that the determination unit 63 determines whether or not to execute the toner discharge process based on the count value N, the determination unit 63 can be configured to determine to execute the toner discharge process if the count value N is equal to or greater than the predetermined value N0. In addition, in the case that a determination on whether or not to execute the toner discharge process is made based on the printing rate R, the configuration can be such that toner discharge process will be executed if the printing rate R is equal to or less than the predetermined value RO.

In this manner, even with the case that the determination unit 63 is configured such that whether or not to execute the toner discharge process is determined based on the count value N or the printing rate R, the printer 1 is able to execute the toner discharge process at appropriate times.

Since when the printing rate is low, the amount of toner being consumed is little, the deterioration of toner progresses and increases the possibility of the accumulation of a portion of toner stored in the developing machine. Consequently, it is especially effective to determine whether or not to execute the toner discharge process based on the printing rate.

(B) In the above described embodiment, a case in which the determination unit 63 determines whether or not to execute the toner discharge process based on whether or not the average printing rate AV is equal to or less than the predetermined value AV0 (here, 3%) is described. However, the configuration can be that, additionally, the predetermined value AV0 is set as a function of the count value N, which is the number of sheets for which the black and white images are formed continuously on recording papers. More specifically, the more the count value N, which is the number of sheets for which the black and white images are formed continuously, a large value is set as the predetermined value AV0. By doing so, it is possible to execute the toner discharge process at more appropriate times.

(C) In the above described embodiment, a case in which when the determination unit 63 determines that toner discharge process is to be executed, the discharge process execution unit 64 rotates the developing unit 13 one revolution is described. However, a configuration can be that the discharge process execution unit 64 rotates (=rotary rotates) the developing unit 13 two or more revolutions. In this case, by rotating (=rotary rotating) the developing unit 13, it becomes more effective in relieving the accumulation of toner in the interior of the black developing machine 13*d*. In addition, the discharge process execution unit 64 can be configured to instruct driving mechanisms such as a motor and the like that drives the developing unit 13 to rotate to speed up or to slow down the rotation speed when driving the developing unit 13 to rotate. In this manner, it is possible to accelerate the developing unit 13 by changing the rotation speed of the developing unit 13, during a single toner discharge process. Therefore, compared to keeping the rotation speed of the developing unit 13 at a constant speed, it becomes more effective in relieving the accumulation of toner in the interior of the black developing machine 13*d*.

Figure 9:
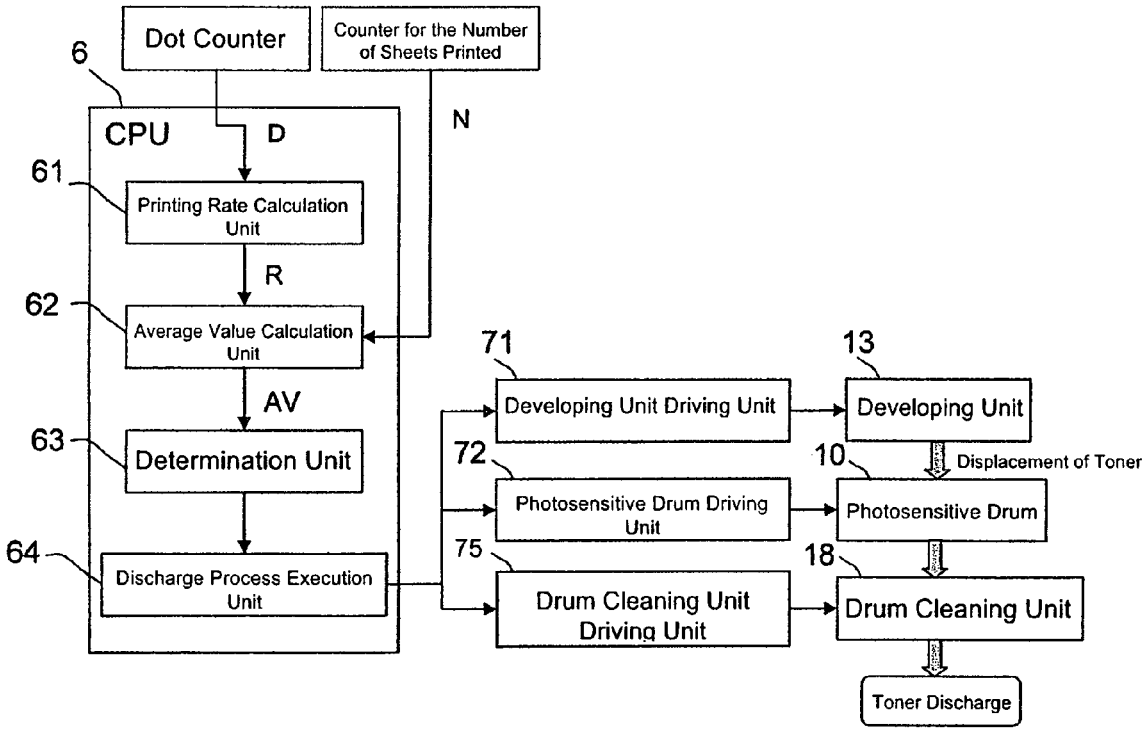
FIG. 9 is a view of a block diagram similar to that of FIG. 6 showing the configuration of additional main portions of the printer.

(D) In the above described embodiment, a case that the discharge process execution unit 64 transfers the toner image formed on the surface of the photosensitive drum 10 onto the surface of the intermediate transfer belt 18, and through the belt cleaning unit 23, toner attached on the surface of the intermediate transfer belt 18 is discharged is described. However, a configuration can be that toner formed on the surface of the photosensitive drum 10 is discharged via the drum cleaning unit 17 (FIG. 9). In this case, since toner attached on the surface of the photosensitive drum is discharged via the drum cleaning unit, it is possible to discharge toner with a simple configuration.

(E) In the above described embodiment, a case in which the image forming device is a printer is described. However, the image forming device can be any image forming device as long as it is configured to form a latent image on the photosensitive drum via a rotary type developing unit having developing machines that correspond to each of toners of two or more predetermined number of colors including a black color, and configured to form toner images of color and black and white on recording papers. More specifically, a configuration can be that the image forming device is a multifunction device having a copying machine that is made of a rotary type developing unit, a fax machine, an Internet facsimile, and functions thereof, as well as any function within the print function.

(F) In the above described embodiment, the average printing rate AV is the average value of the printing rate per sheet in a predetermined number of sheets N0. However, the present invention is not limited thereto. Other than this, the average value calculation unit 62, for example, for N sheets of recording papers, can be configured to calculate the average value of the printing value per sheet. In this case, the determination unit 63 can be configured to determine to execute the toner discharge process if this average value becomes equal to or less than the predetermined value. In this case, the ER is the sum of each printing rate R of the N sheets of recording papers.

(G) In the above described embodiment, the printing rate calculation unit 61 is used for black. However, the present invention is not limited thereto. The printing rate calculation unit 61 is used for all colors.

The above embodiment can be expressed in the following way.

(i) An image forming device in which, through a rotary type developing unit having developing machines that correspond to each of toners of two or more predetermined number of colors including a black color, forms a latent image on the photosensitive drum, and forms color and black and white toner images on recording papers. The image forming device includes a determination unit that determines whether or not to execute a toner discharge process, which is a process to discharge only a predetermined amount of black toner, and a discharge process execution unit that executes the toner discharge process after the developing unit is rotated only a predetermined number of times that is set in advance when the determination unit determined to execute the toner discharge process.

(ii) The image forming device mentioned in the above (i), wherein the determination unit determines to execute the toner discharge process when black and white images are formed continuously for a predetermined number of sheets or more on recording papers.

(iii) The image forming device mentioned in the above (i), wherein when forming a black and white toner image on a recording paper, the determination unit having a printing rate calculation unit that obtains a printing rate determines whether or not to execute the toner discharge process based on the printing rate.

(iv) The image forming device mentioned in the above (i) has a printing rate calculation unit that obtains a printing rate when forming a black and white toner image on a recording paper, and an average value calculation unit that calculates the average printing rate, which is the average value of the printing rate of every predetermined number of sheets when forming black and white images continuously for a predetermined number of sheets or more on recording papers, and furthermore, the determination unit determines whether or not to execute a toner discharge process based on the average printing rate.

(v) The image forming device mentioned in the above (iv), wherein the determination unit determines to execute the toner discharge process when the average printing rate is equal to or less than a predetermined value that is set in advance.

(vi) The image forming device mentioned in any of the above (i) through (v), wherein the discharge process execution unit forms and discharges black toner image on the photosensitive drum via the developing machine that is used for the black color.

(vii) The image forming device mentioned in the above (vi) has a drum cleaning unit that removes and discharges toner attached on the surface of the photosensitive drum, and wherein the discharge process execution unit discharges toner attached on the surface of the photosensitive drum via the drum cleaning unit.

(viii) The image forming device mentioned in the above (vi) includes an intermediate transfer belt on which the toner image formed on the surface of the photosensitive drum is transferred, and a belt cleaning unit that removes and discharges toner attached on the surface of the intermediate transfer belt, and wherein the discharge process execution unit makes the toner image formed on the surface of the photosensitive drum transfer onto the surface of the intermediate transfer belt, and at the same time discharges toner attached on the surface of the intermediate transfer belt via the belt cleaning unit.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

General Interpretation of Terms

In understanding the scope of the present invention, the term "configured" as used herein to describe a component, section, or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including", "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device of the present invention. Accordingly, these terms, as utilized to describe the present invention should be interpreted relative to an image forming device of the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device, comprising: an image carrier configured to carry an electrostatic latent image; a rotary type developing unit having a plurality of developing machines being configured to store toner in the interior thereof and to develop the electrostatic latent image by providing toner on the image carrier; and a control unit being configured to execute a toner discharge process to discharge a portion of the toner in the interior of the at least one of the plurality of developing machines after rotating the developing unit during a time of not forming an image and after a single color image formation using only one of the plurality of developing machines, the control unit including a determination unit configured to determine whether the toner discharge process should be executed, and a discharge process execution unit configured to control the developing unit and to execute the toner discharge process; and a printing rate calculation unit configured to calculate the printing rates of images developed by one of the plurality of developing machines, the determination unit being configured to determine whether the toner discharge process should be executed based on the printing rate, and that the toner discharge process should be executed when the printing rate is equal to or less than a predetermined value.

2. The image forming device as recited in claim 1, further comprising a transfer unit configured to transfer an image developed by at least one of the plurality of developing machines from the image carrier to a recording paper, wherein the determination unit is configured to determine that the toner discharge process should be executed, when a single color image is transferred continuously on a predetermined number of sheets or more of recording papers.

3. The image forming device as recited in claim 1, further comprising a transfer unit configured to transfer an image developed by the plurality of developing machines from the image carrier to a recording paper; and an average value calculation unit configured to calculate an average printing rate considered the average value of the printing rate per sheet of the predetermined number of sheets of recording papers when a single color image is transferred continuously on a predetermined number of sheets or more of recording papers, wherein the determination unit is configured to determine whether the toner discharge process should be executed based on the average printing rate.

4. The image forming device as recited in claim 3, wherein the determination unit is configured to determine that the toner discharge process should be executed if the average printing rate is equal to or less than a predetermined value.

5. The image forming device as recited in claim 3, wherein the larger the number of sheets of recording papers on which a single color image is to be printed, the larger the predetermined value becomes as determined by the determination unit.

6. The image forming device as recited in claim 1, wherein the control unit is configured to discharge the toner by forming a toner image via toner in the interior of the one of the plurality of developing machines on the image carrier and to control the developing unit.

7. The image forming device as recited in claim 6, further comprising a cleaning unit configured to remove toner attached to the surface of the image carrier, wherein the control unit is configured to remove toner attached to the surface of the image carrier via the cleaning unit.

8. The image forming device as recited in claim 6, further comprising an intermediate transfer belt on which the toner image formed on the surface of the image carrier is transferred; and a belt cleaning unit configured to remove toner attached to the surface of the intermediate transfer belt, wherein the control unit is configured to remove toner image formed on the surface of the image carrier and transferred to the surface of the intermediate transfer belt via the belt cleaning unit.

9. The image forming device as recited in claim 1, wherein toner in the interior of one of the plurality of developing machines is black toner.

10. The image forming device as recited in claim 1, wherein at least one of the plurality of developing machines including a chassis, a divider arranged inside the chassis, the divider having a plurality of rectangular openings, a first and a second toner chamber formed by the divider, a mixing paddle adapted and arranged to mix toner stored in the first toner chamber, a developing roller configured to contact the image carrier to transfer toner, a screw adapted and arranged to mix toner stored in the second toner chamber and arranged to convey toner to the first toner chamber, and a blade adapted and arranged to remove excess toner from the developing roller.

11. The image forming device as recited in claim 10, wherein the mixing paddle including a feather member.

12. The image forming device as recited in claim 9, wherein at least one of the plurality of developing machines including a chassis, a divider arranged inside the chassis, the divider having a plurality of rectangular openings, a first and a second toner chamber formed by the divider, a mixing paddle adapted and arranged to mix toner stored in the first toner chamber, a developing roller configured to contact the image carrier to transfer toner, a screw adapted and arranged to mix toner stored in the second toner chamber and arranged to convey toner to the first toner chamber, and a blade adapted and arranged to remove excess toner from the developing roller.

13. The image forming device as recited in claim 12, wherein the mixing paddle having a feather member.

14. An image forming device, comprising:

an image carrier configured to carry an electrostatic latent image;

a rotary type developing unit having a plurality of developing machines being configured to store toner in the interior thereof and to develop the electrostatic latent image by providing toner on the image carrier;

a control unit configured to execute a toner discharge process to discharge a portion of toner in the interior of one of the plurality of developing machines after rotating the developing unit during a time of not forming an image and after a single color image formation using only the one of the plurality of developing machines, the control unit including a determination unit configured to determine whether the toner discharge process should be executed, and a discharge process execution unit configured to control the developing unit and execute the toner discharge process, the determination unit being configured to determine whether the toner discharge process should be executed based on the average printing rate, and that the toner discharge process should be executed if the average printing rate is equal to or less than a predetermined value;

a transfer unit configured and arranged to transfer an image developed by the plurality of developing machines from the image carrier to a recording paper;

a printing rate calculation unit configured to calculate the printing rates of images developed by the plurality of developing machines; and an average value calculation unit configured to calculate an average printing rate considered the average value of the printing rate per sheet of the predetermined number of sheets of recording papers when a single color image is transferred continuously on a predetermined number of sheets or more of recording papers.

* * * * *